US005094999A

United States Patent [19]

Tsuchida et al.

[11] Patent Number: 5,094,999

[45] Date of Patent: Mar. 10, 1992

[54] RECORDING MATERIAL

[75] Inventors: Testsuo Tsuchida, Takarazuka; Fumio Seyama, Osaka; Tatsuya Meguro, Nishinomiya; Mitsuru Kondo, Hyogo, all of Japan

[73] Assignee: Kanzaki Paper Manufacturing Co., Ltd., Tokyo, Japan

[21] Appl. No.: 529,425

[22] Filed: May 29, 1990

[30] Foreign Application Priority Data

May 30, 1989 [JP] Japan ..... 1-136856
Dec. 15, 1989 [JP] Japan ..... 1-326470

[51] Int. Cl.[5] ..... B41M 5/30; B41M 5/32

[52] U.S. Cl. ..... 503/216; 427/150; 503/210; 503/211; 503/212; 503/217; 503/225

[58] Field of Search ..... 427/150; 503/210–212, 503/216, 217, 225

[56] References Cited

U.S. PATENT DOCUMENTS 3,864,146 2/1975 Oda et al. ..... 117/36.8
3,924,027 12/1975 Saito et al. ..... 427/147
4,236,732 12/1980 Murakami et al. ..... 282/27.5
4,771,034 9/1988 Ikeda et al. ..... 503/212
4,918,047 4/1990 Ikeda et al. ..... 503/216

FOREIGN PATENT DOCUMENTS 0067793 12/1982 European Pat. Off. .
0213454 3/1987 European Pat. Off. .

OTHER PUBLICATIONS

Patent Abstract of Japan, vol. 12, No. 416 (1988).

*Primary Examiner*—Bruce H. Hess
*Attorney, Agent, or Firm*—Armstrong, Nikaido, Marmelstein, Kubovcik & Murray

[57] ABSTRACT

A recording material utilizing the reaction between a colorless or light-colored basic dye and a color acceptor reactive with the basic dye to form a color and forming on the same or different substrate a layer or layers containing the basic dye of the color acceptor conjointly or separately, the recording material being characterized in that the color acceptor is at least one of salicyclic acid derivatives represented by the following formula [I] or polyvalent metal salts thereof

[I]

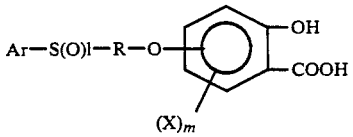

wherein Ar, R, X, l and m are defined in the specification.

15 Claims, No Drawings

RECORDING MATERIAL

The present invention relates to recording materials, and more particularly to recording materials which are excellent in color forming ability, preservability of the material as prepared and preservability of the images recorded thereon.

Recording materials are known which utilize the color forming reaction between a colorless or light-colored basic dye and an organic or inorganic color acceptor. Such materials include pressure sensitive recording materials, heat sensitive recording materials and electrothermal recording materials as typical examples and further include various other materials.

The properties required of these recording materials are sufficient recording density and sensitivity, excellent preservability of recorded images in external environments involving temperature, humidity, light, chemicals or the like, etc., whereas materials fulfilling these requirements completely are still unavailable at present.

Heat sensitive recording materials, for example, are used in various fields and in diversified forms with remarkable progress in heat sensitive recording systems in recent years. While they are useful as recording media for heat sensitive facsimile systems and heat sensitive printers, they are in rapidly growing uses for novel applications, for example, as POS (Point of Sales) labels.

However, heat sensitive recording materials generally have the drawback of becoming fogged up when affected by solvents or the like, or permitting the recorded images to undergo discoloration or fading. Especially, images recorded on the material markedly fade when brought into contact with plastics films, or the material is very susceptible to fogging when stored in contact with diazo copy paper, especially such paper bearing fresh copy images. It is therefore strongly desired to remedy these drawbacks or defects.

In view of the present situation described above, we have conducted extensive research on color acceptors in order to overcome the foregoing defects of the recording materials which utilize the color forming reaction between basic dyes and color acceptors.

An object of the present invention is to provide a recording material which is outstanding not only in color forming ability and preservability as prepared but also in the preservability of recorded images.

The above and other objects of the invention will become apparent from the following description.

The present invention provides a recording material utilizing the reaction between a colorless or light-colored basic dye and a color acceptor reactive with the basic dye to form a color and forming on the same or different substrate a layer or layers containing the basic dye and the color acceptor conjointly or separately, the recording material being characterized in that the color acceptor is at least one of salicylic acid derivatives represented by the following formula [I] or polyvalent metal salts thereof

[I]

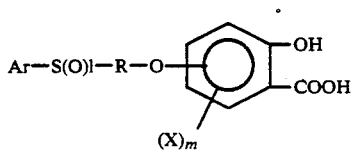

wherein Ar is phenyl group having or not having a substituent, naphthyl group having or not having a substituent, or aromatic heterocyclic group having or not having a substituent, R is alkylene group having or not having an ether bond, thioether bond, ester bond or amido bond, and having or not having a substituent, cycloalkylene group having or not having an ether bond, ester bond or amido bond, alkenylene group having or not having an ether bond, ester bond or amido bond, or alkylene group having an arylene bond, and having or not having an ether bond, ester bond or amido bond, and having or not having a substituent, X is hydrogen atom, alkyl group, cycloalkyl group, alkenyl group, aralkyl group, aryl group, alkoxyl group, aryloxy group, nitro group or halogen atom, l is 1 or 2, and m is an integer of 1 to 3.

The salicylic acid derivative used in the present invention can be prepared by a known method, for example, by alkylating a corresponding hydroxysalicyclic acid derivative, by carboxylating a corresponding phenol derivative or oxidizing a corresponding salicylic acid derivative.

In the salicylic acid derivative of the above formula [I], Ar represents phenyl group having or not having a substituent, naphthyl group having or not having a substituent, or aromatic heterocyclic group having or not having a substituent. Among the above is preferable phenyl group or naphthyl group of the formula [II] below

[II]

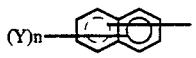

wherein Y is $C_{1\sim20}$ alkyl, $C_{5\sim7}$ cycloalkyl, $C_{2\sim6}$ alkenyl, $C_{6\sim12}$ aryl, $C_{7\sim10}$ aralkyl, $C_{1\sim20}$ alkoxyl, $C_{1\sim20}$ hydroxyalkoxyl, $C_{2\sim20}$ alkoxyalkoxyl, $C_{2\sim6}$ alkenyloxyl, $C_{1\sim6}$ alkylthio, $C_{6\sim12}$ aryloxy, $C_{7\sim10}$ aralkyloxy, $C_{2\sim7}$ alkoxycarbonyl, $C_{2\sim7}$ alkylcarbonyl, $C_{2\sim7}$ alkylcarbonyloxy, nitro, hydroxyl group or halogen atom, n is zero or an integer of 1 to 5.

Further among the phenyl group and naphthyl group of the formula [II] is preferable phenyl group or naphthyl group of the formula [II']

[II']

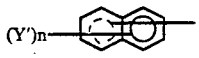

wherein Y' is $C_{1\sim6}$ alkyl, $C_{1\sim6}$ alkoxyl, phenyl, phenoxy group, chlorine atom, bromine atom or fluorine atom, n is zero or an integer of 1 to 5.

In the salicylic acid derivative of the formula [I], R is alkylene group having or not having an ether bond, thioether bond, ester bond or amido bond, and having or not having a substituent, cycloalkylene group having or not having an ether bond, ester bond or amido bond, alkenylene group having or not having an ether bond, ester bond or amido bond, or alkylene group having an arylene bond, and having or not having an ether bond, ester bond or amido bond, and having or not having a substituent. The alkylene group preferably has 1 to 12 carbon atoms, cycloalkylene group 4 to 8 carbon atoms, alkenylene group 2 to 12 carbon atoms and alkylene group having arylene bond 7 to 12 carbon atoms. Examples of substituents for the alkylene group or alkylene group having an arylene bond are cyclohexyl group, phenyl group, halogen atom and hydroxyl group, and the substituent bonds to the alkylene group and not to the arylene group. Among the above, more preferable is $C_{1\sim12}$ alkylene group having or not having ether bond or ester bond.

Further, in the formula [I], X is hydrogen atom, alkyl group, cycloalkyl group, alkenyl group, aralkyl group, aryl group, alkoxyl group, aryloxy group, nitro group or halogen atom, preferably hydrogen atom, $C_{1\sim20}$ alkyl, $C_{5\sim7}$ cycloalkyl, $C_{2\sim6}$ alkenyl, $C_{7\sim10}$ aralkyl, $C_{1\sim20}$ alkoxyl, phenyl, naphthyl, phenoxy, nitro group or halogen atom, and more preferably hydrogen atom, $C_{1\sim6}$ alkyl, $C_{7\sim10}$ aralkyl, $C_{1\sim6}$ alkoxyl, phenyl, phenoxy group, chlorine atom, bromine atom or fluorine atom.

In the formula [I], l is 1 or 2. A sulfone derivative in which l is 2 is preferable since a recording material is obtained which affords recorded images having excellent resistance to chemicals.

Polyvalent metals which forms a salt with the salicylic acid derivative of the formula [I] are preferably those having 2, 3 or 4 valency, and more preferably zinc, calcium, aluminum, magnesium, tin or iron.

The recording material having incorporated therein the salicyclic acid derivative or polyvalent metal salt thereof according to the invention is satisfactory in color density and forms color images which are highly stable and undergo little or no discoloration or fading even when exposed to sunlight for a prolonged period of time or when preserved at high temperatures or high humidities. The material is therefore very advantageous from the viewpoint of long-term preservation of records. The present material is especially usable as a heat sensitive recording material without permitting the blank portion to develop a color due to contact with solvents or the like and without permitting the recorded images to discolor or fade in the presence of oils or fats, chemicals or the like. Thus, the specified compound used exhibits excellent characteristics as a color acceptor.

The followings are examples of the salicylic acid derivatives of the formula [I].

4-phenylsulfonylmethoxysalicylic acid, 5-phenylsulfonylmethoxysalicylic acid, 4-(2-phenylsulfonylethoxy)salicylic acid, 5-(2-phenylsulfonylethoxy)salicylic acid, 4-(3-phenylsulfonylpropyloxy)salicylic acid, 5-(3-phenylsulfonylpropyloxy)salicylic acid, 4-(4-phenylsulfonylbutyloxy)salicylic acid, 5-(4-phenylsulfonylbutyloxy)salicylic acid, 4-(5-phenylsulfonylpentyloxy)salicylic acid, 5-(5-phenylsulfonylpentyloxy)salicylic acid, 4-(6-phenylsulfonylhexyloxy)salicylic acid, 5-(6-phenylsulfonylhexyloxy)salicylic acid, 4-(8-phenylsulfonyloctyloxy)salicylic acid, 5-(8-phenylsulfonyloctyloxy)salicylic acid, 4-(10-phenylsulfonyldecyloxy)salicylic acid, 5-(10-phenylsulfonyldecyloxy)salicylic acid, 4-(12-phenylsulfonyldodecyloxy)salicylic acid, 5-(12-phenylsulfonyldodecyloxy)salicylic acid, 4-(18-phenylsulfonyloctadecyloxy)salicylic acid, 5-(18-phenylsulfonyloctadecyloxy)salicylic acid, 4-(1-methyl-1-phenylsulfonylmethoxy)salicylic acid, 5-(1-methyl-1-phenylsulfonylmethoxy)salicylic acid, 4-(1,1-dimethyl-1-phenylsulfonylmethoxy)salicylic acid, 5-(1,1-dimethyl-1-phenylsulfonylmethoxy)salicylic acid, 4-(5-phenylsulfonyl-3-oxa-pentyloxy)salicylic acid, 5-(5-phenylsulfonyl-3-oxa-pentyloxy)salicylic acid, 4-(8-phenylsulfonyl-3,6-dioxaoctyloxy)salicylic acid, 5-(8-phenylsulfonyl-3,6-dioxaoctyloxy)salicylic acid, 4-(11-phenylsulfonyl-3,6,9-trioxa-undecyloxy)salicylic acid, 5-(11-phenylsulfonyl-3,6,9-trioxa-undecyloxy)salicylic acid, 4-(7-phenylsulfonyl-3,5-dioxa-heptyloxy)salicylic acid, 5-(7-phenylsulfonyl-3,5-dioxa-heptyloxy)salicylic acid, 4-(9-phenylsulfonyl-5-oxa-nonyloxy)salicylic acid, 5-(9-phenylsulfonyl-5-oxa-nonyloxy)salicylic acid, 4-(3-phenylsulfonyl-1-propenyloxy)salicylic acid, 5-(3-phenylsulfonyl-1-propenyloxy)salicylic acid, 4-(4-phenylsulfonyl-2-butenyloxy)salicylic acid, 5-(4-phenylsulfonyl-2-butenyloxy)salicylic acid, 4-(2-phenyl-3-phenylsulfonylpropyloxy)salicylic acid, 5-(2-phenyl-3-phenylsulfonylpropyloxy)salicylic acid, 4-(4-phenylsulfonylmethylbenzyloxy)salicylic acid, 5-(4-phenylsulfonylmethylbenzyloxy)salicylic acid, 4-(3-phenylsulfonylmethylbenzyloxy)salicylic acid, 5-(3-phenylsulfonylmethylbenzyloxy)salicylic acid, 4-(2-cyclohexyl-3-phenylsulfonylpropyloxy)salicylic acid, 5-(2-cyclohexyl-3-phenylsulfonylpropyloxy)salicylic acid, 4-(2-phenylsulfonylacetoxyethoxy)salicylic acid, 5-(2-phenylsulfonylacetoxyethoxy)salicylic acid, 4-(3-phenylsulfonylacetoxypropyloxy)salicylic acid, 5-(3-phenylsulfonylacetoxypropyloxy)salicylic acid, 4-(3-phenylsulfonylpropionyloxymethoxy)salicylic acid, 5-(3-phenylsulfonylpropionyloxymethoxy)salicylic acid, 4-(2-methoxycarbonyl-2-phenylsulfonylethoxy)-salicylic acid, 5-(2-methoxycarbonyl-2-phenylsulfonylethoxy)salicylic acid, 4-(3-p-tolylsulfonylpropyloxycarbonylmethoxy)salicylic acid, 5-(3-p-tolylsulfonylpropyloxycarbonylmethoxy)salicylic acid, 4-[2-(3-p-tolylsulfonylpropyloxycarbonyl)ethoxy]salicylic acid, 5-[2-(3-p-tolylsulfonylpropyloxycarbonyl)ethoxy]salicylic acid, 4-(2-phenylsulfonylacetylaminoethoxy)salicylic acid, 5-(2-phenylsulfonylacetylaminoethoxy)salicylic acid, 4-(3-phenylsulfonylpropionylaminomethoxy)salicylic acid, 5-(3-phenylsulfonylpropionylaminomethoxy)salicylic acid, 4-(5-phenylsulfonyl-3-thio-pentyloxy)salicylic acid, 5-(5-phenylsulfonyl-3-thio-pentyloxy)salicylic acid, 4-[2-(3-phenylsulfonylpropionyl-)ethoxy]salicylic acid, 5-[2-(3-phenylsulfonylpropionyl-)ethoxy]salicylic acid, 4-(p-tolylsulfonylmethoxy)salicylic acid, 5-(p-tolylsulfonylmethoxy)salicylic acid, 4-(2-p-tolylsulfonylethoxy)salicylic acid, 5-(2-p-tolylsulfonylethoxy)salicylic acid, 4-(3-p-tolylsulfonylpropyloxy)salicylic acid, 5-(3-p-tolylsulfonylpropyloxy)salicylic acid, 4-(4-p-tolylsulfonylbutyloxy)salicylic acid, 5-(4-p-tolylsulfonylbutyloxy)salicylic acid, 4-(5-p-tolylsulfonylpentyloxy)salicylic acid, 5-(5-p-tolylsulfonylpentyloxy)salicylic acid, 4-(6-p-tolylsulfonylhexyloxy)salicylic acid, 5-(6-p-tolylsulfonylhexyloxy)salicylic acid, 4-(8-p-tolylsulfonyloctyloxy)salicylic acid, 5-(8-p-tolylsulfonyloctyloxy)salicylic acid, 4-(10-p-tolylsulfonyldecyloxy)salicylic acid, 5-(10-p-tolylsulfonyldecyloxy)salicylic acid, 4-(12-p-tolylsulfonyldodecyloxy)salicylic acid, 5-(12-p-tolylsulfonyldodecyloxy)salicylic acid, 4-(18-p-tolylsulfonyloctadecyloxy)salicylic acid, 5-(18-p-tolylsulfonyloctadecyloxy)salicylic acid, 4-(1-methyl-1-p-tolylsulfonylmethoxy)salicylic acid, 5-(1-methyl-1-p-tolylsulfonylmethoxy)salicylic acid, 4-(1,1-dimethyl-1-p-tolylsulfonylmethoxy)salicylic acid, 5-(1,1-dimethyl-1-p-tolylsulfonylmethoxy)salicylic acid, 4-(5-p-tolylsulfonyl-3-oxa-pentyloxy)salicylic acid, 5-(5-p-tolylsulfonyl-3-oxa-pentyloxy)salicylic acid, 4-(8-p-tolylsulfonyl-3,6-dioxaoctyloxy)salicylic acid, 5-(8-p-tolylsulfonyl-3,6-dioxaoctyloxy)salicylic acid, 4-(11-p-tolylsulfonyl-3,6,9-trioxa-undecyloxy)salicylic acid, 5-(11-p-tolylsulfonyl-3,6,9-trioxa-undecyloxy)salicylic acid, 4-(7-p-tolylsulfonyl-3,5-dioxa-heptyloxy)salicylic acid, 5-(7-p-tolylsulfonyl-3,5-dioxa-heptyloxy)salicylic acid, 4-(9-p-tolylsulfonyl-5-oxa-nonyloxy)salicylic acid, 5-(9-p-tolylsulfonyl-5-oxa-nonyloxy)salicylic acid, 4-(3-p-tolylsulfonyl-1-propenyloxy)salicylic acid, 5-(3-p-tolylsulfonyl-1-propenyloxy)salicylic acid, 4-(4-p-tolylsulfonyl-2-butenyloxy)salicylic acid, 5-(4-p-tolylsulfonyl-2-butenyloxy)salicylic acid, 4-(2-hydroxy-3-p-tolylsulfonylpropyloxy)salicylic acid, 5-(2-hydroxy-3-p-tolylsulfonylpropyloxy)salicylic acid, 4-(2-chloro-3-p-tolylsulfonylpropyloxy)salicylic acid, 5-(2-chloro-3-p-tolylsulfonylpropyloxy)salicylic acid, 4-(2-phenyl-3-p-tolylsulfonylpropyloxy)salicylic acid, 5-(2-phenyl-3-p-tolylsulfonylpropyloxy)salicylic acid, 4-(4-p-tolylsulfonylmethylbenzyloxy)salicylic acid, 5-(4-p-tolylsulfonylmethylbenzyloxy)salicylic acid, 4-(3-p-tolylsulfonylmethylbenzyloxy)salicylic acid, 5-(3-p-tolylsulfonylmethylbenzyloxy)salicylic acid, 4-(2-cyclohexyl-3-p-tolylsulfonylpropyloxy)salicylic acid, 5-(2-cyclohexyl-3-p-tolylsulfonylpropyloxy)salicylic acid, 4-(4-p-tolylsulfonylcyclohexyloxy)salicylic acid, 5-(4-p-tolylsulfonylcyclohexyloxy)salicylic acid, 4-(3-p-tolylsulfonylcyclohexyloxy)salicylic acid, 5-(3-p-tolylsulfonylcyclohexyloxy)salicylic acid, 4-(2-p-tolylsulfonylcyclohexyloxy)salicylic acid, 5-(2-p-tolylsulfonylcyclohexyloxy)salicylic acid, 4-(1-p-tolylsulfonylcyclohexyloxy)salicylic acid, 5-(1-p-tolylsulfonylcyclohexyloxy)salicylic acid, 4-(2-o-tolylsulfonylethoxy)salicylic acid, 5-(2-o-tolylsulfonylethoxy)salicylic acid, 4-(2-m-tolylsulfonylethoxy)salicylic acid, 5-(2-m-tolylsulfonylethoxy)salicylic acid 4-(2-p-ethylphenylsulfonylethoxy)salicylic acid, 5-(2-p-ethylphenylsulfonylethoxy)salicylic acid, 4-(3-p-ethylphenylsulfonylpropyloxy)salicylic acid, 5-(3-p-ethylphenylsulfonylpropyloxy)salicylic acid, 4-(2-p-propylphenylsulfonylethoxy)salicylic acid, 5-(2-p-propylphenylsulfonylethoxy)salicylic acid, 4-(2-p-isopropylphenylsulfonylethoxy)salicylic acid, 5-(2-p-isopropylphenylsulfonylethoxy)salicylic acid, 4-(2-p-hexylphenylsulfonylethoxy)salicylic acid, 5-(2-p-hexylphenylsulfonylethoxy)salicylic acid, 4-(3-p-nonylphenylsulfonylpropyloxy)salicylic acid, 5-(3-p-nonylphenylsulfonylpropyloxy)salicylic acid, 4-(3-p-pentadecylphenylsulfonylpropyloxy)salicylic acid, 5-(3-p-pentadecylphenylsulfonylpropyloxy)salicylic acid, 4-(2-p-methoxyphenylsulfonylethoxy)salicylic acid, 5-(2-p-methoxyphenylsulfonylethoxy)salicylic acid, 4-(2-o-methoxyphenylsulfonylethoxy)salicylic acid, 5-(2-o-methoxyphenylsulfonylethoxy)salicylic acid, 4-(2-m-methoxyphenylsulfonylethoxy)salicylic acid, 5-(2-m-methoxyphenylsulfonylethoxy)salicylic acid, 4-(2-p-ethoxyphenylsulfonylethoxy)salicylic acid, 5-(2-p-ethoxyphenylsulfonylethoxy)salicylic acid, 4-(2-p-isopropyloxyphenylsulfonylethoxy)salicylic acid, 5-(2-p-isopropyloxyphenylsulfonylethoxy)salicylic acid, 4-(2-p-butyloxyphenylsulfonylethoxy)salicylic acid, 5-(2-p-butyloxyphenylsulfonylethoxy)salicylic acid, 4-(2-p-hexyloxyphenylsulfonylethoxy)salicylic acid, 5-(2-p-hexyloxyphenylsulfonylethoxy)salicylic acid, 4-(3-p-methoxyphenylsulfonylpropyloxy)salicylic acid, 5-(3-p-methoxyphenylsulfonylpropyloxy)salicylic acid, 4-(3-p-isopropyloxyphenylsulfonylpropyloxy)salicylic acid, 5-(3-p-isopropyloxyphenylsulfonylpropyloxy)salicylic acid, 4-(3-p-tert-butyloxyphenylsulfonylpropyloxy)salicylic acid, 5-(3-p-tert-butyloxyphenylsulfonylpropyloxy)salicylic acid, 4-(4-p-methoxyphenylsulfonylbutyloxy)salicylic acid, 5-(4-p-methoxyphenylsulfonylbutyloxy)salicylic acid, 4-(4-p-isopropyloxyphenylsulfonylbutyloxy)salicylic acid, 5-(4-p-isopropyloxyphenylsulfonylbutyloxy)salicylic acid, 4-(3-p-dodecyloxyphenylsulfonylpropyloxy)salicylic acid, 5-(3-p-dodecyloxyphenylsulfonylpropyloxy)salicylic acid, 4-(3-p-octadecyloxyphenylsulfonylpropyloxy)salicylic acid, 5-(3-p-octadecyloxyphenylsulfonylpropyloxy)salicylic acid, 4-(3-p-allyloxyphenylsulfonylpropyloxy)salicylic acid, 5-(3-p-allyloxyphenylsulfonylpropyloxy)salicylic acid, 4-[3-p-(2-methoxyethoxy)phenylsulfonylpropyloxy]salicylic acid, 5-[3-p-(2-methoxyethoxy)phenylsulfonylpropyloxy]salicylic acid, 4-[3-p-(2-ethoxyethoxy)phenylsulfonylpropyloxy]salicylic acid, 5-[3-p-(2-ethoxyethoxy)phenylsulfonylpropyloxy]salicylic acid, 4-[3-p-(6-ethoxyhexyloxy)phenylsulfonylpropyloxy]salicylic acid, 5-[3-p-(6-ethoxyhexyloxy)phenylsulfonylpropyloxy]salicylic acid, 4-[3-p-(12-ethoxydodecyloxy)phenylsulfonylpropyloxy]salicylic acid, 5-[3-p-(12-ethoxydodecyloxy)phenylsulfonylpropyloxy]salicylic acid, 4-[3-p-(2-hydroxyethoxy)phenylsulfonylpropyloxy]salicylic acid, 5-[3-p-(2-hydroxyethoxy)phenylsulfonylpropyloxy]salicylic acid, 4-[3-p-(3-hydroxypropyloxy)phenylsulfonylpropyloxy]salicylic acid, 5-[3-p-(3-hydroxypropyloxy)phenylsulfonylpropyloxy]salicylic acid, 4-[3-p-(8-hydroxyoctyloxy)phenylsulfonylpropyloxy]salicylic acid, 5-[3-p-(8-hydroxyoctyloxy)phenylsulfonylpropyloxy]salicylic acid, 4-[3-p-(18-hydroxyoctadecyloxy)phenylsulfonylpropyloxy]salicylic acid, 5-[3-p-(18-hydroxyoctadecyloxy)phenylsulfonylpropyloxy]salicylic acid, 4-(2-p-biphenylsulfonylethoxy)salicylic acid, 5-(2-p-biphenylsulfonylethoxy)salicylic acid, 4-(2-o-biphenylsulfonylethoxy)salicylic acid, 5-(2-o-biphenylsulfonylethoxy)salicylic acid, 4-(2-m-biphenylsulfonylethoxy)salicylic acid, 5-(2-m-biphenylsulfonylethoxy)salicylic acid, 4-(2-p-phenoxyphenylsulfonylethoxy)salicylic acid, 5-(2-p-phenoxyphenylsulfonylethoxy)salicylic acid, 4-(2-p-chlorophenylsulfonylethoxy)salicylic acid, 5-(2-p-chlorophenylsulfonylethoxy)salicylic acid, 4-(3-p-chlorophenylsulfonylpropyloxy)salicylic acid, 5-(3-p-chlorophenylsulfonylpropyloxy)salicylic acid, 4-(4-p-chlorophenylsulfonylbutyloxy)salicylic acid, 5-(4-p-chlorophenylsulfonylbutyloxy)salicylic acid, 4-(2-o-chlorophenylsulfonylethoxy)salicylic acid, 5-(2-o-chlorophenylsulfonylethoxy)salicylic acid, 4-(2-p-bromophenylsulfonylethoxy)salicylic acid, 5-(2-p-bromophenylsulfonylethoxy)salicylic acid, 4-(2-p-fluorophenylsulfonylethoxy)salicylic acid, 5-(2-p-fluorophenylsulfonylethoxy)salicylic acid, 4-(2-p-cyclohexylphenylsulfonylethoxy)salicylic acid, 5-(2-p-cyclohexylphenylsulfonylethoxy)salicylic acid, 4-(2-p-allylphenylsulfonylethoxy)salicylic acid, 5-(2-p-allylphenylsulfonylethoxy)salicylic acid, 4-(2-p-benzylphenylsulfonylethoxy)salicylic acid, 5-(2-p-benzylphenylsulfonylethoxy)salicylic acid, 4-(2-p-methylthiophenylsulfonylethoxy)salicylic acid, 5-(2-p-methylthiophenylsulfonylethoxy)salicylic acid, 4-(2-p-benzyloxyphenylsulfonylethoxy)salicylic acid, 5-(2-p-benzyloxyphenylsulfonylethoxy)salicylic acid, 4-(3-p-benzyloxyphenylsulfonylpropyloxy)salicylic acid, 5-(3-p-benzyloxyphenylsulfonylpropyloxy)salicylic acid, 4-(2-p-phenethyloxyphenylsulfonylethoxy)salicylic acid, 5-(2-p-phenethyloxyphenylsulfonylethoxy)salicylic acid, 4-(2-p-methyloxycarbonylphenylsulfonylethoxy)salicylic acid, 5-(2-p-methyloxycarbonylphenylsulfonylethoxy)salicylic acid, 4-(2-p-acetylphenylsulfonylethoxy)salicylic acid, 5-(2-p-acetylphenylsulfonylethoxy)salicylic acid, 4-(2-p-benzoylphenylsulfonylethoxy)salicylic acid, 5-(2-p-benzoylphenylsulfonylethoxy)salicylic acid, 4-(2-p-acetyloxyphenylsulfonylethoxy)salicylic acid, 5-(2-p-acetyloxyphenylsulfonylethoxy)salicylic acid, 4-(2-p-nitrophenylsulfonylethoxy)salicylic acid, 5-(2-p-nitrophenylsulfonylethoxy)salicylic acid, 4-(2-p-hydroxyphenylsulfonylethoxy)salicylic acid, 5-(2-p-hydroxyphenylsulfonylethoxy)salicylic acid, 4-(2-m-hydroxyphenylsulfonylethoxy)salicylic acid, 5-(2-m-hydroxyphenylsulfonylethoxy)salicylic acid, 4-[2-(3,5-dimethylphenylsulfonyl)ethoxy]salicylic acid, 5-[2-(3,5-dimethylphenylsulfonyl)ethoxy]salicylic acid, 4-[2-(3,4,5-trimethylphenylsulfonyl)ethoxy]salicylic acid, 5-[2-(3,4,5-trimethylphenylsulfonyl)ethoxy]salicylic acid, 4-[2-(3,5-dichlorophenylsulfonyl)ethoxy]salicylic acid, 5-[2-(3,5-dichlorophenylsulfonyl)ethoxy]salicylic acid, 4-[2-(3,4,5-trichlorophenylsulfonyl)ethoxy]salicylic acid, 5-[2-(3,4,5-trichlorophenylsulfonyl)ethoxy]salicylic acid, 4-[2-(3-chloro-4-methylphenylsulfonyl)ethoxy]salicylic acid, 5-[2-(3-chloro-4-methylphenylsulfonyl)ethoxy]salicylic acid, 4-[3-(3-chloro-4-methylphenylsulfonyl)propyloxy]salicylic acid, 5-[3-(3-chloro-4-methylphenylsulfonyl)propyloxy]salicylic acid, 4-[2-(1-naphthylsulfonyl)ethoxy]salicylic acid, 5-[2-(1-naphthylsulfonyl)ethoxy]salicylic acid, 4-[2-(4-methyl-1-naphthylsulfonyl)ethoxy]salicylic acid, 5-[2-(4-methyl-1-naphthylsulfonyl)ethoxy]salicylic acid, 4-[2-(4-methoxy-1-naphthylsulfonyl)ethoxy]salicylic acid, 5-[2-(4-methoxy-1-naphthylsulfonyl)ethoxy]salicylic acid, 4-[2-(4-benzyloxy-1-naphthylsulfonyl)ethoxy]salicylic acid, 5-[2-(4-benzyloxy-1-naphthylsulfonyl)ethoxy]salicylic acid, 4-[2-(2-naphthylsulfonyl)ethoxy]salicylic acid, 5-[2-(2-naphthylsulfonyl)ethoxy]salicylic acid, 4-[3-(2-naphthylsulfonyl)propyloxy]salicylic acid, 5-[3-(2-naphthylsulfonyl)propyloxy]salicylic acid, 4-[2-(6-methyl-2-naphthylsulfonyl)ethoxy]salicylic acid, 5-[2-(6-methyl-2-naphthylsulfonyl)ethoxy]salicylic acid, 4-[2-(6-methoxy-2-napthylsulfonyl)ethoxy]salicylic acid, 5-[2-(6-methoxy-2-napthylsulfonyl)ethoxy]salicylic acid, 4-[2-(6-benzyloxy-2-naphthylsulfonyl)ethoxy]salicylic acid, 5-[2-(6-benzyloxy-2-naphthylsulfonyl)ethoxy]salicylic acid, 4-[2-(2-pyridinylsulfonyl)ethoxy]salicylic acid, 5-[2-(2-pyridinylsulfonyl)ethoxy]salicylic acid, 3-methyl-4-(2-p-tolylsulfonylethoxy)salicylic acid, 3-methyl-5-(2-p-tolylsulfonylethoxy)salicylic acid, 3-methyl-4-(3-p-tolylsulfonylpropyloxy)salicylic acid, 3-methyl-5-(3-p-tolylsulfonylpropyloxy)salicylic acid, 3,5-dimethyl-4-(2-p-tolylsulfonylethoxy)salicylic acid, 3-cyclohexyl-4-(2-p-tolylsulfonylethoxy)salicylic acid, 3-allyl-4-(2-p-tolylsulfonylethoxy)salicylic acid, 3-α,α-dimethylbenzyl-4-(2-p-tolylsulfonylethoxy)salicylic acid, 3-α-methylbenzyl-4-(3-p-tolylsulfonylpropyloxy)salicylic acid, 3-phenyl-4-(2-p-tolylsulfonylethoxy)salicylic acid, 3-acetyloxy-4-(2-p-tolylsulfonylethoxy)salicylic acid, 3-phenoxy-4-(2-p-tolylsulfonylethoxy)salicylic acid, 4-chloro-5-(2-p-tolylsulfonylethoxy)salicylic acid, 5-chloro-4-(2-p-tolylsulfonylethoxy)salicylic acid, 4-bromo-5-(2-p-tolylsulfonylethoxy)salicylic acid, 5-bromo-4-(2-p-tolylsulfonylethoxy)salicylic acid, 3,5-dichloro-4-(2-p-tolylsulfonylethoxy)salicylic acid, 3-methoxy-5-(2-phenylsulfonylethoxy)salicylic acid, 3-methoxy-5-(2-p-tolylsulfonylethoxy)salicylic acid, 5-nitro-4-(2-p-tolylsulfonylethoxy)salicylic acid, 4-phenylsulfinylmethoxysalicylic acid, 5-phenylsulfinylmethoxysalicylic acid, 4-(2-phenylsulfinylethoxy)salicylic acid, 5-(2-phenylsulfinylethoxy)salicylic acid, 4-(3-phenylsulfinylpropyloxy)salicylic acid, 5-(3-phenylsulfinylpropyloxy)salicylic acid, 4-(4-phenylsulfinylbutyloxy)salicylic acid, 5-(4-phenylsulfinylbutyloxy)salicylic acid, 4-(6-phenylsulfinylhexyloxy)salicylic acid, 5-(6-phenylsulfinylhexyloxy)salicylic acid, 4-(12-phenylsulfinyldodecyloxy)salicylic acid, 5-(12-phenylsulfinyldodecyloxy)salicylic acid, 4-(5-phenylsulfinyl-3-oxa-pentyloxy)salicylic acid, 5-(5-phenylsulfinyl-3-oxa-pentyloxy)salicylic acid, 4-(8-phenylsulfinyl-3,6-dioxa-octyloxy)salicylic acid, 5-(8-phenylsulfinyl-3,6-dioxa-octyloxy)salicylic acid, 4-(2-p-chlorophenylsulfinylethoxy)salicylic acid, 5-(2-p-chlorophenylsulfinylethoxy)salicylic acid, 4-(2-p-tolylsulfinylethoxy)salicylic acid, 5-(2-p-tolylsulfinylethoxy)salicylic acid, 4-(3-p-tolylsulfinylpropyloxy)salicylic acid, 5-(3-p-tolylsulfinylpropyloxy)salicylic acid, 4-(2-p-methoxyphenylsulfinylethoxy)salicylic acid, 5-(2-p-methoxyphenylsulfinylethoxy)salicylic acid, 4-(3-p-methoxyphenylsulfinylpropyloxy)salicylic acid, 5-(3-p-methoxyphenylsulfinylpropyloxy)salicylic acid, 4-(2-p-biphenylsulfinylethoxy)salicylic acid, 5-(2-p-biphenylsulfinylethoxy)salicylic acid, etc.

These salicylic acid derivatives and/or polyvalent metal salts thereof are used, as required, in a mixture of at least two of them.

The amount of the salicylic acid derivative and/or polyvalent metal salt thereof is not particularly limited but is usually 0.1 to 50 parts by weight, preferably 2 to 10 parts by weight per part by weight of the basic dye.

In the present invention, although the recording material which is excellent in color forming ability, preservability of the material as prepared and preservability of the recorded images can be obtained by use of, as a color acceptor the salicylic acid derivative of the formula [I] and/or polyvalent metal salt thereof, the above properties can be further enhanced by conjoint use of a metal compound.

Examples of these metal compounds are oxide, hydroxide, sulfide, halide, carbonate, phosphate, silicate, sulfate, nitrate or halogen complex salt of a metal having 2, 3 or 4 valency such as zinc, magnesium, barium, calcium, aluminum, tin, titanium, nickel, cobalt, manganese or iron. Among these, particularly preferable is zinc compound.

Examples of the metal compounds are zinc oxide, zinc hydroxide, zinc aluminate, zinc sulfide, zinc carbonate, zinc phosphate, zinc silicate, aluminum oxide, magnesium oxide, titanium oxide, aluminum hydroxide, aluminum silicate, aluminum phosphate, magnesium aluminate, magnesium hydroxide, magnesium carbonate and magnesium phosphate. These metal compounds can be used, as required, in a mixture of at least two of them.

The amount of the metal compound is not necessarily limited and is usually 1 to 500 parts by weight, preferably 5 to 300 parts by weight per 100 parts by weight of the salicylic acid derivative of the formula [I] and/or polyvalent metal salt thereof.

In the present recording material, it is possible to use conjointly various other known color acceptors such as a salicylic acid derivative, phenol derivative, phenol resin and acidic clay in an amount which does not cause adverse effect. The followings are examples of the known color acceptors.

Inorganic color acceptors:

Acidic clay, activated clay, attapulgite, bentonite, colloidal silica, aluminum silicate, magnesium silicate, zinc silicate, tin silicate, calcined kaolin and talc.

Organic color acceptors:

Aliphatic carboxylic acids, e.g., oxalic acid, maleic acid, tartaric acid, citric acid, succinic acid and stearic acid.

Aromatic carboxylic acids, e.g., benzoic acid, 4-tert-butylbenzoic acid, 4-chlorobenzoic acid, 4-nitro-benzoic acid, phthalic acid, gallic acid, salicylic acid, 3-isopropylsalicylic acid, 3-phenylsalicylic acid, 3-cyclohexylsalicylic acid, 3,5-di-tert-butylsalicylic acid, 3-methyl-5-benzylsalicylic acid, 3-phenyl-5-(α,α-dimethylbenzyl)salicylic acid, 3,5-di-(α-methylbenzyl)salicylic acid and 2-hydroxy-1-benzyl-3-naphthoic acid.

Phenolic compounds, e.g., 4,4'-isopropylidenediphenol (bisphenol A), 4,4'-isopropylidenebis(2-chlorophenol), 4,4'-isopropylidenebis(2,6-dichlorophenol), 4,4'-isopropylidenebis(2,6-dibromophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 2,2'-bis(4-hydroxyphenyl)-4-methylpentane, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, methyl 4-hydroxybenzoate, benzyl 4-hydroxybenzoate, 2,2'-thiobis(4,6-dichlorophenol), 4-tert-octylcatechol, 2,2'-methylenebis(4-chlorophenol), 2,2'-methylenebis(4-methyl-6-tert-butylphenol), 2,2'-dihydroxydiphenyl, methyl bis(4-hydroxyphenyl)acetate, ethyl bis(4-hydroxyphenyl)acetate, butyl bis(4-hydroxyphenyl)acetate, benzyl bis(4-hydroxyphenyl)acetate, 4,4'-(p-phenylenediisopropylidene)diphenol, 4,4'-(m-phenylenediisopropylidene)diphenol, 4-hydroxydiphenylsulfone, 4,4'-dihydroxydiphenylsulfone, 4-hydroxy-4'-methyl-diphenylsulfone, 4-hydroxy-4'-isopropoxydiphenylsulfone, 4-hydroxy-3',4'-tetramethylenediphenylsulfone, 2,2'-diallyl-4,4'-dihydroxydiphenylsulfone, 2-phenoxyethyl bis(4-hydroxyphenyl)acetate, p-hydroxy-N-(2-phenoxyethyl)benzenesulfonamide, dimethyl 4-hydroxyphthalate, 1,5-bis(4-hydroxyphenylthio)-3-oxa-pentane, 1,7-bis(4-hydroxyphenylthio)-3,5-dioxa-heptane, 1,8-bis(4-hydroxyphenylthio)-3,6-dioxa-octane and 2-(4-hydroxyphenylthio)ethyl (4-hydroxyphenylthio)acetate.

Phenolic resins, e.g., p-phenylphenol-formalin resin and p-butylphenol-acetylene resin.

Salt of the organic color acceptor with a polyvalent metal such as zinc, magnesium, aluminum, calcium, titanium, manganese, tin and nickel.

Metal complex, e.g., antipyrine complex with zinc thiocyanate.

In the present recording material, various dyes are known as the colorless or light-colored basic dye which is used in combination with the above specific color acceptor. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(4-dimethylaminophenyl)-3-(4-diethylamino-2-methylphenyl)-6-(dimethylamino)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Divinylphthalide-based dyes, e.g., 3,3-bis[1,1-bis(4-pyrrolidinophenyl)ethylene-2-yl]-4,5,6,7-tetrabromophthalide, 3,3-bis[1-(4-methoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, etc.

Thiazine-based dyes, e.g., benzoylleucomethyleneblue, p-nitrobenzoyl-leucomethyleneblue, etc.

Spiro-based dyes, e.g., 3-methyl-spirodinaphthopyran, 3-ethyl-spiro-dinaphthopyran, 3-phenylspirodinaphthopyran, 3-benzyl-spiro-dinaphthopyran, 3-methyl-naphtho(6'-methoxybenzo)spiropyran, 3-propyl-spirodibenzopyran, etc.

Lactam-based dyes, e.g., rhodamine-B-anilinolactam, rhodamine(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 4-benzylamino-8-diethylaminobenzo[a]fluoran, 3-[4-(4-dimethylaminoanilino)anilino]-7-chloro-6-methylfluoran, 8-[4-(4-dimethylaminoanilino)anilino]-benzo[a]fluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-(N-ethyl-N-tetrahydrofurfurylamino)-6-methyl-7-phenylaminofluoran, 3-(N-methyl-N-n-propylamino)-6-methyl-7-phenylaminofluoran, 3-(N-ethyl-N-isobutylamino)-6-methyl-7-phenylaminofluoran, 3-(N-methyl-N-n-hexylamino)-6-methyl-7-phenylaminofluoran, 3-dipentylamino-6-methyl-7-phenylaminofluoran, 3-[N-(3-ethoxypropyl)-N-methylamino]-6-methyl-7-phenylaminofluoran, 3-[N-ethyl-N-(3-ethoxypropyl)amino]-6-methyl-7-phenylaminofluoran, 3-diethylamino-7-[m-(trifluoromethyl)phenylamino]fluoran, 3-diethylamino-7-(o-fluorophenylamino)fluoran, 3-dibutylamino-7-(o-fluorophenylamino)fluoran, 3-diethylamino-6-chloro-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, etc.

Fluorene-based dyes, e.g., 3,6-bis(dimethylamino)-fluorene-9-spiro-3'-(6'-dimethylamino)phthalide, 3-diethylamino-6-(N-allyl-N-methylamino)fluorene-9-spiro-3'-(6'-dimethylamino)phthalide, 3,6-bis(dimethylamino)-spiro[fluorene-9,6'-6'H-chromeno(4,3-b)indole], 3,6-bis(dimethylamino)-3'-methyl-spiro[fluorene-9,6'-6'H-chromeno(4,3-b)indole], 3,6-bis(diethylamino)-3'-methyl-spiro[fluorene-9,6'-6'H-chromeno(4,3-b)indole], These basic dyes are not limited to thereabove and can be used, as required, in a mixture of at least two of them.

In case of a heat sensitive recording material and the like among the present recording materials, it is possible to use various heat-fusible substances as the record sensitivity improving agent to obtain high-speed recording amenability. Examples of heat-fusible substances are caproic acid amide, capric acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide; polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(2-methylphenoxy)-2-(4-methoxyphenoxy)ethane, terephthalic acid dibenzyl ester, dibenzyl oxalate, di(4-methylbenzyl) oxalate, benzyl p-benzyloxybenzoate, p-benzylbiphenyl, 1,5-bis(p-methoxyphenoxy)-3-oxa-pentane, 1,4-bis(2-vinyloxyethoxy)benzene, p-biphenyl p-tolyl ether and benzyl p-methylthiophenyl ether. The amount of the heat-fusible substance is not particularly limited and is usually 50 to 700 parts by weight, preferably 100 to 500 parts by weight per 100 parts by weight of the basic dye.

A detailed description will be given of typical recording materials which have incorporated therein salicylic acid derivatives of the formula [I] and/or polyvalent metal salts thereof, along with basic dyes such as those mentioned above.

Pressure sensitive recording materials are of various types as disclosed, for example, in U.S. Pat. Nos. 2,505,470, 2,505,471, 2,505,489, 2,548,366, 2,712,507, 2,730,456, 2,730,457, 3,418,250, 3,924,027, 4,010,038, etc. The present invention is applicable to such a wide variety of pressure sensitive recording materials.

Generally, color acceptor sheets (under sheets) are prepared by dispersing at least one of the salicylic acid derivatives or polyvalent metal salts thereof according to the invention in an binder, such as styrene-butadiene copolymer latex or polyvinyl alcohol, along with other color acceptors and pigments which are used as required to obtain a color acceptor coating composition, and applying the composition to a suitable substrate such as paper, plastics sheet or resin-coated paper.

On the other hand, basic dye sheets (upper sheets) for use in combination with such color acceptor sheets are prepared by dissolving a basic dye in a suitable solvent, dispersing the solution in a binder and applying the dispersion to a suitable substrate such as paper, plastics sheet or resin-coated paper. Examples of useful solvents are alkylated naphthalene, alkylated diphenyl, alkylated diphenylmethane, alkylated terphenyl and like synthetic oils; cotton seed oil, caster oil and like vegetable oils; animal oils; mineral oils; and mixtures of such oils. Alternatively, the dispersion to be applied to the substrate is prepared by encapsulating the solution of basic dye by the coacervation process, interfacial polymerization process, in-situ polymerization process or other encapsulation process and dispersing the resulting microcapsules in a binder.

The pressure sensitive recording materials to be prepared according to the invention of course include middle sheets which are prepared by applying the color acceptor coating composition to one surface of a substrate and applying the dye dispersion or dye encapsulated dispersion to the other surface; self-contained type pressure sensitive recording sheets which are prepared by coating one surface of a substrate with a composition containing dye capsules and the color acceptor in mixture, or with the dye encapsulated dispersion and further with the color acceptor coating composition, so as to make the encapsulated dye and the color acceptor conjointly present on the same surface; and sheets of other types as already stated.

The amounts of basic dye and color acceptor to be used vary with the desired amount to be applied to the substrate, type of pressure sensitive recording material, encapsulating process, composition of the liquid to be applied inclusive of auxiliary agents, method of application and like conditions, so that the amounts are suitably determined in accordance with the conditions involved.

Heat sensitive recording materials are of various types as disclosed, for example, in JP-B-3680/1969, -27880/1969, -14039/1970, -43830/1973, -69/1974, -70/1974 and 20142/1977. The salicylic acid derivatives or polyvalent metal salts of the invention can be used for such a wide variety of heat sensitive recording materials.

Generally, heat sensitive recording materials are prepared according to the invention by dispersing a basic dye and at least one of the salicylic acid derivatives of the invention or polyvalent metal salts thereof in a medium having a binder dissolved or dispersed therein, and applying the resulting dispersion to a suitable substrate such as paper, plastics film, synthetic paper, woven fabric sheet or molding. Although the proportions of basic dye and color acceptor to be used for the recording layer are not limited specifically, the color acceptor is used generally in an amount of 50 to 700 parts by weight, preferably about 100 to about 500 parts by weight, per 100 parts by weight of the dye.

Among the basic dyes to be used, 3-dibutylamino-6-methyl-7-phenylaminofluoran is especially desirable to use since this dye is excellent in color forming ability and least likely to permit fogging of the blank portion.

According to the present invention, the salicylic acid derivative of the formula [I] or polyvalent metal salt thereof is usable in combination with other color acceptors as already stated. Among other useful color acceptors, it is desirable to use in this case 4-hydroxy-4'-isopropoxydiphenyl sulfone since the heat sensitive recording material then obtained exhibits an especially high color density and is least susceptable to the fogging of blank areas. The proportion of other color acceptor to be used, although not limited specifically, is 10 to 100 parts by weight, preferably about 50 to about 100 parts by weight, per 100 parts by weight of the salicylic acid derivative of the formula [I] or polyvalent metal salt thereof.

To give improved color forming ability, deluster the surface of the recording layer and assure improved writability, inorganic pigments can be used generally in an amount of 0.1 to 10 parts by weight, preferably about 0.5 to about 3 parts by weight, per part by weight of the color acceptor. When required, it is further possible to conjointly use various auxiliary agents, such as dispersant, ultraviolet absorber, heat-fusible substance, defoaming agent, fluorescent dye, coloring dye, etc.

As already described, the heat sensitive recording material of the invention is prepared generally by dispersing a finely divided basic dye and a finely divided color acceptor in a medium and coating a substrate with the dispersion, while separate dispersions of the basic dye and the color acceptor may be applied to the substrate in the form of a double coating. It is of course possible to prepare the material by impregnation or paper making process.

The method of preparing the coating composition or the method of application is not specifically limited. The dispersion or coating composition is applied generally in an amount of about 2 to about 12 g/m$^2$ by dry weight. Further it is possible to form an overcoat layer over the recording layer to protect this layer, or to provide a primary coating layer over the substrate. Thus, various techniques known in the art can be suitably resorted to.

Examples of suitable binders are starches, celluloses, proteins, gum arabic, polyvinyl alcohols, styrene-maleic anhydride copolymer salts, styrene-butadiene copolymer emulsion, vinyl acetate-maleic anhydride copolymer salts, polyacrylates, etc. Such a binder is used in an amount of 10 to 40 wt %, preferably about 15 to about 30 wt %, based on the total solids content of the coating composition.

Electrothermal recording materials are prepared, for example, by methods disclosed in JP-A-11344/1974 and -48930/1975. Such materials are produced generally by preparing a coating composition in the form of a dispersion of an electrically conductive substance, basic dye, color acceptor and binder, and applying the composition to a suitable substrate such as paper, or by coating the substrate with the electrically conductive substance to form a conductive layer, and further coating the layer with a coating composition in the form of a dispersion of dye, color acceptor and binder. In the case where neither of the dye and the color acceptor melt at preferred temperatures of 70° to 120° C., a suitable heat-fusible substance can be used in combination therewith to afford adjusted sensitivity to Joule heat.

The invention will be described below in more detail with reference to Examples by no means limited to, in which parts and percentages are all by weight, unless otherwise specified.

EXAMPLE 1

In 100 parts of isopropylnaphthalene was dissolved 6 parts of 3-(N-ethyl-N-isoamylamino)-6-methyl-7-phenylaminofluoran. The solution was added to 350 parts of warm (50° C.) water having dissolved therein 25 parts of pig skin gelatin of isoelectric point of 8 and 25 parts of gum arabic to obtain an emulsion. To the emulsion was added 1000 parts of warm water and the mixture was adjusted to pH 4 with the addition of acetic acid, then cooled to 10° C. Thereto was added 10 parts of 25% aqueous solution of glutaraldehyde to cure capsules. The capsule-containing composition was applied to one of the surfaces of a paper substrate weighing 45 g/m$^2$ in an amount of 5 g/m$^2$ by dry weight to prepare a basic dye sheet.

Separately, in 200 parts of water were dispersed 20 parts of zinc salt of 4-(2-p-tolylsulfonylethoxy)salicylic acid, 80 parts of kaolin and 30 parts of styrene-butadiene copolymer emulsion (50% solid) to prepare a coating composition containing a color acceptor. The coating composition was applied to a paper substrate weighing 45 g/m$^2$ in an amount of 5 g/m$^2$ by dry weight to obtain a color acceptor sheet.

The basic dye sheet and the color acceptor sheet were superposed with their coating surfaces opposed to each other, the assembly was pressed with a pen, then black images were obtained immediately which were high in color density and excellent in resistance to light.

EXAMPLES 2 to 4

Three kinds of color acceptor sheets were prepared in the same manner as in Example 1 except that the following color acceptor was used in place of 20 parts of zinc salt of 4-(2-p-tolylsulfonylethoxy)salicylic acid in the preparation of the color acceptor sheet in Example 1.

| | | |
|---|---|---|
| Example 2: | zinc salt of 4-(3-p-tolysulfonyl-propyloxy)salicylic acid | 20 parts |
| Example 3: | zinc salt of 4-(2-p-methoxyphenylsulfonyl-ethoxy)salicylic acid | 20 parts |
| Example 4: | zinc salt of 3,5-bis(α-methylbenzyl)-salicylic acid | 10 parts |
| | zinc salt of 4-(2-p-tolysulfonylethoxy)-salicylic acid | 10 parts |

The color formation was made in the same manner as in Example 1 with use of the above color acceptor sheet. In each of Examples 2 to 4, black images were obtained immediately which were high in color density and excellent in resistance to light.

EXAMPLE 5 e,crc/1/ Composition A

| | |
|---|---|
| 3-(N-ethyl-N-isoamylamino)-6-methyl-7-phenylaminofluoran | 10 parts |
| 1,2-di(3-methylphenoxy)ethane | 20 parts |
| 5% aqueous solution of methyl cellulose | 20 parts |
| water | 110 parts |

These components were pulverized by a sand mill to prepare Composition A having an average particle size of 2 μm.

② Composition B

| | |
|---|---|
| 4-(2-p-tolysulfonylethoxy)salicylic acid | 30 parts |
| 5% aqueous solution of methyl cellulose | 60 parts |
| water | 110 parts |

These components were pulverized by a sand mill to prepare Composition B having an average particle size of 3 μm.

e,crc/3/ Formation of a recording layer

A coating composition was prepared by mixing with stirring 160 parts of Composition A, 200 parts of Composition B, 30 parts of finely divided anhydrous silica (oil absorption 180 ml/100 g), 150 parts of 20% aqueous solution of oxidized starch and 210 parts of water. To a paper substrate weighing 50 g/m$^2$ was applied and dried the above coating composition in an amount of 6.0 g/m$^2$ by dry weight to obtain a heat sensitive recording paper.

EXAMPLES 6 TO 12 AND COMPARISON EXAMPLES 1 TO 2

Nine kinds of heat sensitive recording papers were prepared in the same manner as in Example 5 except that the following compound was used in place of 4-(2-p-tolylsulfonylethoxy)salicylic acid in the preparation of the Composition B in Example 5.

Example 6: 4-(3-p-tolylsulfonylpropyloxy)salicylic acid

Example 7: 4-(4-p-tolylsulfonylbutyloxy)salicylic acid
Example 8: 4-(5-p-tolylsulfonyl-3-oxa-pentyloxy)salicylic acid
Example 9: 4-(2-p-chlorophenylsulfonylethoxy)salicylic acid
Example 10: 4-(2-phenylsulfonylethoxy)salicylic acid
Example 11: 4-(2-p-methoxyphenylsulfonylethoxy)salicylic acid
Example 12: 5-(2-p-ptolylsulfonylethoxy)salicylic acid
Comparison Example 1: 3,5-di(α-methylbenzyl)salicylic acid
Comparison Example 2: 4-dodecyloxysalicylic acid

EXAMPLES 13 TO 38 AND COMPARISON EXAMPLES 3 TO 4

Twenty eight kinds of heat sensitive recording papers were prepared in the same manner as in Example 5 except that the following compound was used in place of 4-(2-p-tolylsulfonylethoxy)salicylic acid in the preparation of the Composition B in Example 5.

Example 13: zinc salt of 4-(2-p-tolylsulfonylethoxy)salicylic acid
Example 14: zinc salt of 4-(3-p-tolylsulfonylpropyloxy)-salicylic acid
Example 15: zinc salt of 4-(4-p-tolylsulfonylbutyloxy)-salicylic acid
Example 16: zinc salt of 4-(5-p-tolylsulfonyl-3-oxa-pentyloxy)salicylic acid
Example 17: zinc salt of 4-(2-p-chlorophenylsulfonylethoxy)salicylic acid
Example 18: zinc salt of 4-(2-phenylsulfonylethoxy)salicylic acid
Example 19: zinc salt of 4-(2-p-methoxyphenylsulfonylethoxy)salicylic acid
Example 20: zinc salt of 4-(3-p-methoxyphenylsulfonylpropyloxy)salicylic acid
Example 21: zinc salt of 4-(3-p-isopropyloxyphenylsulfonylpropyloxy)salicylic acid
Example 22: zinc salt of 5-(2-p-tolylsulfonylethoxy)salicylic acid
Example 23: zinc salt of 4-(6-p-tolylsulfonylhexyloxy)-salicylic acid
Example 24: zinc salt of 4-(7-p-tolylsulfonyl-3,5-dioxaheptyloxy)salicylic acid
Example 25: zinc salt of 5-(4-phenylsulfonylmethylbenzyloxy)salicylic acid
Example 26: zinc salt of 4-(4-p-tolylsulfonylcyclohexyloxy)salicylic acid
Example 27: zinc salt of 4-(4-p-tolylsulfonyl-2-butenyloxy)salicylic acid
Example 28: zinc salt of 4-(3-p-ethylphenylsulfonylpropyloxy)salicylic acid
Example 29: zinc salt of 5-(2-o-biphenylsulfonylethoxy)salicylic acid
Example 30: zinc salt of 4-[3-(3-chloro-4-methylphenylsulfonyl)propyloxy]salicylic acid
Example 31: zinc salt of 4-(2-p-acetyloxyphenylsulfonylethoxy)salicylic acid
Example 32: zinc salt of 4-[3-(2-naphthylsulfonyl)-propyloxy]salicylic acid
Example 33: zinc salt of 3-methyl-4-(3-p-tolylsulfonylpropyloxy)salicylic acid
Example 34: zinc salt of 3-methoxy-5-(2-phenylsulfonylethoxy)salicylic acid
Example 35: zinc salt of 5-bromo-4-(2-p-tolylsulfonylethoxy)salicylic acid
Example 36: calcium salt of 4-(2-p-tolylsulfonylethoxy)-salicylic acid
Example 37: magnesium salt of 4-(2-p-tolylsulfonylethoxy)salicylic acid
Example 38: aluminum salt of 4-(2-p-tolylsulfonylethoxy)salicylic acid
Comparison Example 3: zinc salt of 3,5-di(α-methylbenzyl)salicylic acid
Comparison Example 4: zinc salt of 4-dodecyloxysalicylic acid

EXAMPLE 39

A heat sensitive recording paper was prepared in the same manner as in Example 5 except that 30 parts of zinc oxide and 80 parts of water were used in place of 110 parts of water in the preparation of the Composition B in Example 5.

EXAMPLES 40 TO 62 AND COMPARISON EXAMPLES 5 TO 6

Twenty five kinds of heat sensitive recording papers were prepared in the same manner as in Example 39 except that the following compound was used in place of 4-(2-p-tolylsulfonylethoxy)salicylic acid in the preparation of the Composition B in Example 39.

Example 40: 4-(3-p-tolylsulfonylpropyloxy)salicylic acid
Example 41: 4-(4-p-tolylsulfonylbutyloxy)salicylic acid
Example 42: 4-(5-p-tolysulfonyl-3-oxa-pentyloxy)salicylic acid
Example 43: 4-(2-p-chlorophenylsulfonylethoxy)salicylic acid
Example 44: 4-(2-phenylsulfonylethoxy)salicylic acid
Example 45: 4-(2-p-methoxyphenylsulfonylethoxy)salicylic acid
Example 46: 4-(3-p-methoxyphenylsulfonylpropyloxy)-salicylic acid
Example 47: 4-(3-p-isopropyloxyphenylsulfonylpropyloxy)salicylic acid
Example 48: 4-(3-p-hexyloxyphenylsulfonylpropyloxy)-salicylic acid
Example 49: 4-(3-p-dodecyloxyphenylsulfonylpropyloxy)salicylic acid
Example 50: 5-(2-p-tolylsulfonylethoxy)salicylic acid
Example 51: 4-(12-p-tolylsulfonyldodecyloxy)salicylic acid
Example 52: 4-(2-phenylsulfonylacetoxyethoxy)salicylic acid
Example 53: 4-(2-p-hexylphenylsulfonylethoxy)salicylic acid
Example 54: 4-(3-p-pentadecylphenylsulfonylpropyloxy)salicylic acid
Example 55: 5-(2-p-phenoxyphenylsulfonylethoxy)salicylic acid
Example 56: 4-(3-p-benzyloxyphenylsulfonylpropyloxy)salicylic acid
Example 57: 4-(2-p-hydroxyphenylsulfonylethoxy)salicylic acid
Example 58: 5-[2-(4-methyl-1-naphthylsulfonyl)ethoxy]salicylic acid
Example 59: 3-α-methylbenzyl-4-(3-p-tolylsulfonylpropyloxy)salicylic acid
Example 60: 3-phenyl-4-(2-p-tolylsulfonylethoxy)salicylic acid
Example 61: 4-(3-phenylsulfinylpropyloxy)salicylic acid
Example 62: 5-(2-p-tolylsufinylethoxy)salicylic acid Comparison Example 5: 3,5-di(α-methylbenzyl)salicylic acid
Comparison Example 6: 4-dodecyloxysalicylic acid

EXAMPLES 63 TO 70

Eight kinds of heat sensitive recording papers were prepared in the same manner as in Example 39 except that the following compound was used in place of 4-(2-p-tolylsulfonylethoxy)salicylic acid in the preparation of the Composition B in Example 39.

Example 63: zinc salt of 4-(2-p-tolylsulfonylethoxy)salicylic acid
Example 64: zinc salt of 4-(3-p-tolylsulfonylpropyloxy)-salicylic acid
Example 65: zinc salt of 4-(5-p-tolylsulfonyl-3-oxa-pentyloxy)salicylic acid
Example 66: zinc salt of 4-(2-phenylsulfonylethoxy)salicylic acid
Example 67: zinc salt of 5-(2-p-tolylsulfonylethoxy)salicylic acid
Example 68: calcium salt of 4-(2-p-tolylsulfonylethoxy)-salicylic acid
Example 69: magnesium salt of 4-(2-p-tolylsulfonylethoxy)salicylic acid
Example 70: aluminum salt of 4-(2-p-tolylsulfonylethoxy)salicylic acid

EXAMPLES 71 TO 73

Three kinds of heat sensitive recording papers were prepared in the same manner as in Example 39 except that the following compound was used in place of zinc oxide in the preparation of Composition B in Example 39.

Example 71: calcium carbonate
Example 72: magnesium oxide
Example 73: aluminum oxide

EXAMPLE 74

A heat sensitive recording paper was prepared in the same manner as in Example 14 except that 3-dibutylamino-6-methyl-7-phenylaminofluoran was used in place of 3-(N-ethyl-N-isoamylamino)-6-methyl-7-phenylaminofluoran in the preparation of Composition A in Example 14.

EXAMPLE 75

A heat sensitive recording paper was prepared in the same manner as in Example 40 except that 3-dibutylamino-6-methyl-7-phenylaminofluoran was used in place of 3-(N-ethyl-N-isoamylamino)-6-methyl-7-phenylaminofluoran in the preparation of Composition A in Example 40.

EXAMPLE 76

A heat sensitive recording paper was prepared in the same manner as in Example 74 except that 30 parts of 4-hydroxy-4'-isopropoxydiphenylsulfone was used conjointly with 30 parts of zinc salt of 4-(3-p-tolysulfonylpropyloxy)salicylic acid in the preparation of Composition B and 230 parts of Composition B was used in the formation of the recording layer.

EXAMPLE 77

A heat sensitive recording paper was prepared in the same manner as in Example 75 except that 30 parts of 4-hydroxy-4'-isopropoxydiphenylsulfone was used conjointly with 30 parts of 4-(3-p-tolysulfonylpropyloxy)-salicylic acid in the preparation of Composition B and 230 parts of Composition B was used in the formation of the recording layer.

COMPARISON EXAMPLES 7 TO 9

Three kinds of heat sensitive recording papers were prepared in the same manner as in Example 5 except that the following compound was used in place of 4-(2-p-tolylsulfonylethoxy)salicylic acid in the preparation of Composition B in Example 5.

Comparison Example 7: 4,4'-isopropylidenediphenol
Comparison Example 8: 4,4'-cyclohexylidenebisphenol
Comparison Example 9: zinc salt of p-chlorobenzoic acid The 82 kinds of heat sensitive recording papers thus prepared were fed to a heat sensitive facsimile system (Model HIFAX-700, product of Hitachi Ltd.) for recording and checked for color density of the recorded images by a Macbeth densitometer (Model RD-914). Tables 1 to 4 show the results.

The heat sensitive recording papers used for recording were allowed to stand in a dry atmosphere at a high temeperature of 60° C. for 20 hours or under the conditions of 40° C. and 90% RH for 20 hours, and thereafter checked again for the color density of the recorded images to evaluate the resistance of the images to heat and moisture. Tables 1 to 4 also show the results.

Further for the evaluation of chemical resistance, the heat sensitive recording papers used for recording were allowed to stand at room temperature for 20 hours with polyvinyl chloride film superposed on the image bearing surface (plasticizer resistance), or coated with ethanol over the image bearing surface (alcohol resistance), or coated with cotton seed oil over the image bearing surface (oil resistance), and were checked for the fogging of blank areas and the degree of fading of the recorded images. Tables 1 to 4 show the result.

The results given in Tables 1 to 4 reveal that the recording materials of the present invention are high in color density, excellent in the preservability of recorded images and free of fading of color images and blank areas fogging due to chemicals.

In Tables 1 to 4,
◎: extremely excellent
○: excellent
Δ: practically usable
X: practically unusable

TABLE 1

| | color density | color density | | plasticizer resistance | | alcohol resistance | | oil resistance | |
|---|---|---|---|---|---|---|---|---|---|
| | color density | after heat resistance test | after moisture resistance test | fogging | fading | fogging | fading | fogging | fading |
| Ex. 5 | 1.22 | 1.14 | 1.08 | ○ | Δ | Δ | ○ | ○ | ○ |
| Ex. 6 | 1.23 | 1.14 | 1.10 | ○ | Δ | Δ | ○ | ○ | ○ |
| Ex. 7 | 1.20 | 1.10 | 1.05 | ○ | Δ | Δ | ○ | ○ | ○ |
| Ex. 8 | 1.18 | 1.07 | 1.04 | ○ | Δ | ○ | ○ | ○ | ○ |
| Ex. 9 | 1.21 | 1.16 | 1.11 | ○ | Δ | Δ | ○ | ○ | ○ |

TABLE 1-continued

| | color density | | | plasticizer resistance | | alcohol resistance | | oil resistance | |
|---|---|---|---|---|---|---|---|---|---|
| | color density | after heat resistance test | after moisture resistance test | fogging | fading | fogging | fading | fogging | fading |
| Ex. 10 | 1.23 | 1.12 | 1.07 | ○ | Δ | Δ | ○ | ○ | ○ |
| Ex. 11 | 1.22 | 1.13 | 1.06 | ○ | Δ | ○ | ○ | ○ | ○ |
| Ex. 12 | 1.21 | 1.12 | 1.04 | ○ | Δ | Δ | ○ | ○ | ○ |
| Com. Ex. 1 | 1.08 | 0.98 | 0.89 | X | Δ | X | ○ | X | Δ |
| Com. Ex. 2 | 1.06 | 0.92 | 0.75 | ○ | X | Δ | Δ | ○ | X |

TABLE 2

| | color density | | | plasticizer resistance | | alcohol resistance | | oil resistance | |
|---|---|---|---|---|---|---|---|---|---|
| | color density | after heat resistance test | after moisture resistance test | fogging | fading | fogging | fading | fogging | fading |
| Ex. 13 | 1.26 | 1.20 | 1.18 | ○ | ○ | ○ | ○ | ○ | ◎ |
| Ex. 14 | 1.25 | 1.20 | 1.16 | ○ | ○ | ○ | ○ | ○ | ◎ |
| Ex. 15 | 1.24 | 1.19 | 1.17 | ○ | ○ | Δ | ○ | ○ | ◎ |
| Ex. 16 | 1.22 | 1.15 | 1.10 | ○ | ○ | ○ | ○ | ○ | ○ |
| Ex. 17 | 1.25 | 1.20 | 1.17 | ○ | ○ | ○ | ○ | ○ | ◎ |
| Ex. 18 | 1.27 | 1.19 | 1.16 | ○ | ○ | Δ | ○ | ○ | ○ |
| Ex. 19 | 1.24 | 1.18 | 1.14 | ○ | ○ | ○ | ○ | ○ | ○ |
| Ex. 20 | 1.24 | 1.19 | 1.16 | ○ | ○ | ○ | ○ | ○ | ◎ |
| Ex. 21 | 1.23 | 1.19 | 1.14 | ○ | ○ | ○ | ○ | ○ | ◎ |
| Ex. 22 | 1.23 | 1.16 | 1.14 | ○ | ○ | Δ | ○ | ○ | ○ |
| Ex. 23 | 1.23 | 1.15 | 1.12 | ○ | ○ | ○ | ○ | ○ | ○ |
| Ex. 24 | 1.22 | 1.13 | 1.10 | ○ | ○ | ○ | ○ | ○ | ○ |
| Ex. 25 | 1.18 | 1.10 | 1.05 | ○ | Δ | Δ | ○ | ○ | ○ |
| Ex. 26 | 1.17 | 1.09 | 1.04 | ○ | Δ | Δ | ○ | ○ | ○ |
| Ex. 27 | 1.19 | 1.10 | 1.06 | ○ | Δ | Δ | ○ | ○ | ○ |
| Ex. 28 | 1.25 | 1.19 | 1.15 | ○ | ○ | ○ | ○ | ○ | ○ |
| Ex. 29 | 1.23 | 1.20 | 1.17 | ○ | ○ | Δ | ○ | ○ | ○ |
| Ex. 30 | 1.25 | 1.20 | 1.17 | ○ | ○ | Δ | ○ | ○ | ○ |
| Ex. 31 | 1.22 | 1.13 | 1.07 | ○ | Δ | Δ | ○ | ○ | ○ |
| Ex. 32 | 1.25 | 1.20 | 1.18 | ○ | ○ | ○ | ○ | ○ | ○ |
| Ex. 33 | 1.24 | 1.19 | 1.15 | ○ | ○ | Δ | ○ | ○ | ○ |
| Ex. 34 | 1.23 | 1.17 | 1.13 | ○ | ○ | ○ | ○ | ○ | ○ |
| Ex. 35 | 1.24 | 1.19 | 1.14 | ○ | ○ | Δ | ○ | ○ | ○ |
| Ex. 36 | 1.23 | 1.16 | 1.11 | ○ | Δ | ○ | ○ | ○ | ○ |
| Ex. 37 | 1.22 | 1.15 | 1.10 | ○ | Δ | ○ | ○ | ○ | ○ |
| Ex. 38 | 1.24 | 1.16 | 1.12 | ○ | Δ | ○ | ○ | ○ | ○ |
| Com. Ex. 3 | 1.16 | 1.10 | 1.01 | X | ○ | X | ○ | X | ○ |
| Com. Ex. 4 | 1.13 | 0.98 | 0.83 | ○ | X | ○ | Δ | ○ | Δ |

TABLE 3

| | color density | | | plasticizer resistance | | alcohol resistance | | oil resistance | |
|---|---|---|---|---|---|---|---|---|---|
| | color density | after heat resistance test | after moisture resistance test | fogging | fading | fogging | fading | fogging | fading |
| Ex. 39 | 1.28 | 1.25 | 1.23 | ○ | ○ | ○ | ○ | ○ | ◎ |
| Ex. 40 | 1.30 | 1.26 | 1.24 | ○ | ○ | ○ | ○ | ○ | ◎ |
| Ex. 41 | 1.25 | 1.23 | 1.20 | ○ | ◎ | ○ | ○ | ○ | ◎ |
| Ex. 42 | 1.24 | 1.22 | 1.21 | ○ | ○ | ○ | ○ | ○ | ◎ |
| Ex. 43 | 1.26 | 1.23 | 1.20 | ○ | ◎ | ○ | ○ | ○ | ◎ |
| Ex. 44 | 1.28 | 1.24 | 1.20 | ○ | ○ | ○ | ○ | ○ | ◎ |
| Ex. 45 | 1.25 | 1.23 | 1.21 | ○ | ○ | ○ | ○ | ○ | ◎ |
| Ex. 46 | 1.28 | 1.24 | 1.22 | ○ | ○ | ○ | ○ | ○ | ◎ |
| Ex. 47 | 1.26 | 1.23 | 1.21 | ○ | ○ | ○ | ○ | ○ | ◎ |
| Ex. 48 | 1.25 | 1.22 | 1.20 | ○ | ○ | ○ | ○ | ○ | ◎ |
| Ex. 49 | 1.24 | 1.13 | 1.06 | ○ | Δ | ○ | ○ | ○ | ○ |
| Ex. 50 | 1.26 | 1.23 | 1.22 | ○ | ○ | ○ | ○ | ○ | ◎ |
| Ex. 51 | 1.25 | 1.22 | 1.20 | ○ | ○ | ○ | ○ | ○ | ◎ |
| Ex. 52 | 1.28 | 1.25 | 1.22 | ○ | ○ | ○ | ○ | ○ | ◎ |
| Ex. 53 | 1.25 | 1.22 | 1.20 | ○ | ○ | ○ | ○ | ○ | ◎ |
| Ex. 54 | 1.24 | 1.14 | 1.08 | ○ | Δ | ○ | ○ | ○ | ○ |
| Ex. 55 | 1.26 | 1.24 | 1.21 | ○ | ○ | ○ | ○ | ○ | ◎ |
| Ex. 56 | 1.24 | 1.15 | 1.08 | ○ | Δ | ○ | ○ | ○ | ○ |
| Ex. 57 | 1.25 | 1.12 | 1.05 | ○ | Δ | Δ | ○ | ○ | ○ |
| Ex. 58 | 1.26 | 1.24 | 1.22 | ○ | ○ | ○ | ○ | ○ | ◎ |
| Ex. 59 | 1.28 | 1.25 | 1.23 | ○ | ○ | ○ | ○ | ○ | ◎ |
| Ex. 60 | 1.26 | 1.22 | 1.20 | ○ | ○ | ○ | ○ | ○ | ◎ |
| Ex. 61 | 1.25 | 1.20 | 1.15 | ○ | Δ | ○ | Δ | ○ | ○ |
| Ex. 62 | 1.24 | 1.19 | 1.13 | ○ | Δ | ○ | Δ | ○ | ○ |
| Com. Ex. 5 | 1.18 | 1.13 | 1.03 | X | ○ | X | ○ | X | ○ |
| Com. Ex. 6 | 1.17 | 1.00 | 0.85 | ○ | X | ○ | Δ | ○ | Δ |

TABLE 4

| | color density | | | plasticizer resistance | | alcohol resistance | | oil resistance | |
|---|---|---|---|---|---|---|---|---|---|
| | color density | after heat resistance test | after moisture resistance test | fogging | fading | fogging | fading | fogging | fading |
| Ex. 63 | 1.30 | 1.27 | 1.25 | ○ | ◎ | ○ | ◎ | ○ | ◎ |
| Ex. 64 | 1.32 | 1.28 | 1.26 | ○ | ◎ | ○ | ◎ | ○ | ◎ |
| Ex. 65 | 1.28 | 1.26 | 1.25 | ○ | ◎ | ○ | ◎ | ○ | ◎ |
| Ex. 66 | 1.30 | 1.27 | 1.26 | ○ | ◎ | ○ | ◎ | ○ | ◎ |
| Ex. 67 | 1.29 | 1.26 | 1.25 | ○ | ◎ | ○ | ◎ | ○ | ◎ |
| Ex. 68 | 1.30 | 1.28 | 1.26 | ○ | ◎ | ○ | ◎ | ○ | ◎ |
| Ex. 69 | 1.29 | 1.26 | 1.24 | ○ | ◎ | ○ | ◎ | ○ | ◎ |
| Ex. 70 | 1.28 | 1.26 | 1.23 | ○ | ◎ | ○ | ◎ | ○ | ◎ |
| Ex. 71 | 1.27 | 1.23 | 1.21 | ○ | ○ | ○ | ○ | ○ | ○ |
| Ex. 72 | 1.25 | 1.22 | 1.20 | ○ | ○ | ○ | ○ | ○ | ○ |
| Ex. 73 | 1.27 | 1.23 | 1.21 | ○ | ○ | ○ | ○ | ○ | ○ |
| Ex. 74 | 1.25 | 1.19 | 1.15 | ◎ | ○ | ◎ | ○ | ◎ | ◎ |
| Ex. 75 | 1.30 | 1.25 | 1.23 | ◎ | ○ | ◎ | ○ | ◎ | ◎ |
| Ex. 76 | 1.35 | 1.31 | 1.29 | ◎ | ○ | ◎ | ○ | ◎ | ◎ |
| Ex. 77 | 1.38 | 1.35 | 1.31 | ◎ | ○ | ◎ | ○ | ◎ | ◎ |
| Com. Ex. 7 | 1.12 | 0.90 | 0.70 | ○ | X | X | ○ | Δ | X |
| Com. Ex. 8 | 1.05 | 0.93 | 0.78 | Δ | X | X | ○ | Δ | X |
| Com. Ex. 9 | 1.02 | 0.96 | 0.92 | X | Δ | X | ○ | X | ○ |

We claim:

1. A recording material utilizing the reaction between a colorless or light-colored basic dye and a color acceptor reactive with the basic dye to form a color, the recording material being characterized in that the color acceptor is at least one of salicylic acid derivatives represented by the following formula I or polyvalent metal salts thereof

[I]

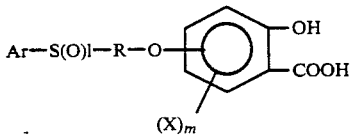

wherein Ar is unsubstituted or substituted phenyl group, substituted or unsubstituted naphthyl group, or substituted or unsubstituted aromatic heterocyclic group, R is substituted or unsubstituted alkylene group which may optionally be interrupted with an ether bond, thioether bond, ester bond or amido bond, cycloalkylene group which may optionally be interrupted with an ether bond, ester bond or amido bond, alkenylene group which may optionally be interrupted with an ether bond, ester bond or amido bond, or substituted or unsubstituted alkylene group having an arylene bond, and which may optionally be interrupted with an ether bond, ester bond or amido bond, X is hydrogen atom, alkyl group, cycloalkyl group, alkenyl group, aralkyl group, aryl group, alkoxyl group, aryloxy group, nitro group or halogen atom, l is 1 or 2, and m is an integer of 1 to 3.

2. A recording material as defined in claim 1 wherein Ar in the formula [I] is phenyl group or naphthyl group of the formula [II].

[II]

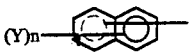

wherein Y is $C_{1\sim20}$ alkyl, $C_{5\sim7}$ cycloalkyl, $C_{2\sim6}$ alkenyl, $C_{6\sim12}$ aryl, $C_{7\sim10}$ aralkyl, $C_{1\sim20}$ alkoxyl, $C_{1\sim20}$ hydroxyalkoxyl, $C_{2\sim20}$ alkoxyalkoxyl, $C_{2\sim6}$ alkenyloxyl, $C_{1\sim6}$ alkylthio, $C_{6\sim12}$ aryloxy, $C_{7\sim10}$ aralkyloxy, $C_{2\sim7}$ alkoxycarbonyl, $C_{2\sim7}$ alkylcarbonyl, $C_{2\sim7}$ alkylcarbonyloxy, nitro, hydroxyl group or halogen atom, n is zero or an integer of 1 to 5.

3. A recording material as defined in claim 2 wherein Ar in the formula [I] is phenyl group or naphthyl group of the formula [II']

[II']

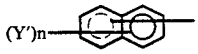

wherein Y' is $C_{1\sim6}$ alkyl, $C_{1\sim6}$ alkoxyl, phenyl, phenoxy group, chlorine atom, bromine atom or fluorine atom, n is zero or an integer of 1 to 5.

4. A recording material as defined in claim 1 wherein R in the formula I is substituted or unsubstituted $C_{1\sim12}$ alkylene group which optionally may be interrupted with an ether bond, thioether bond, ester bond or amido bond, $C_{4\sim8}$ cycloalkylene group which optionally may be interrupted with an ether bond, ester bond or amido bond, $C_{2\sim12}$ alkenylene group which optionally may be interrupted with an ether bond, ester bond or amido bond, or substituted or unsubstituted $C_{7\sim12}$ alkylene group having an arylene bond, and which may optionally be interrupted with an ether bond, ester bond or amido bond.

5. A recording material as defined in claim 4 wherein R in the formula I is said $C_{1\sim12}$ alkylene group which may optionally be interrupted with an ether bond or ester bond.

6. A recording material as defined in claim 1 wherein X in the formula [I] is hydrogen atom, $C_{1\sim20}$ alkyl, $C_{5\sim7}$ cycloalkyl, $C_{2\sim6}$ alkenyl, $C_{7\sim10}$ aralkyl, $C_{1\sim20}$ alkoxyl, phenyl, naphthyl, phenoxy, nitro group or halogen atom.

7. A recording material as defined in claim 6 wherein X in the formula [I] is hydrogen atom, $C_{1\sim6}$ alkyl, $C_{7\sim10}$ aralkyl, $C_{1\sim6}$ alkoxyl, phenyl, phenoxy group, chlorine atom, bromine atom or fluorine atom.

8. A recording material as defined in claim 1 wherein l is 2 in the formula [I].

9. A recording material as defined in claim 1 wherein said color acceptor comprises at least one of the salicylic acid derivative of the formula I or polyvalent metal salt thereof together with a metal compound.

10. A recording material as defined in claim 9 wherein the metal compound is used in an amount of 1 to 500 parts by weight per 100 parts by weight of at least one selected from the group consisting of the salicylic acid derivative or polyvalent metal salt thereof.

11. A recording material as defined in claim 1 wherein the recording material is a heat sensitive recording material.

12. A recording material as defined in claim 11 wherein the colorless or light-colored basic dye is 3-dibutylamino-6-methyl-7-phenylaminofluoran.

13. A recording material as defined in claim 11 wherein, as the color acceptor, is further used 4-hydroxy-4'-isopropoxydiphenylsulfone.

14. A recording material as defined in claim 1 wherein the recording material is a pressure sensitive recording material.

15. A recording material as defined in claim 1 wherein at least one selected from the group consisting of the salicylic acid derivative or polyvalent metal salt thereof is used in an amount of 0.1 to 50 parts by weight per part by weight of the basic dye.

* * * * *

UNITED STATES PATENT AND TRADEMARK OFFICE

CERTIFICATE OF CORRECTION

PATENT NO. : 5,094,999

DATED : March 10, 1992

INVENTOR(S) : Tetsuo TSUCHIDA et al

It is certified that error appears in the above-identified patent and that said Letters Patent is hereby corrected as shown below:

On the cover page, Item [75] delete "Testsuo Tsuchida", insert therefor -- Tetsuo Tsuchida --.

Signed and Sealed this

Twentieth Day of July, 1993

*Attest:*

*Attesting Officer*

Michael K. Kirk

MICHAEL K. KIRK

*Acting Commissioner of Patents and Trademarks*